US008695112B2

(12) United States Patent
Bhatnagar et al.

(10) Patent No.: US 8,695,112 B2
(45) Date of Patent: Apr. 15, 2014

(54) FLEXIBLE BODY ARMOR WITH SEMI-RIGID AND FLEXIBLE COMPONENT

(75) Inventors: Ashok Bhatnagar, Richmond, VA (US); David A. Hurst, Richmond, VA (US); Brian D. Arvidson, Chester, VA (US); Lori L. Wagner, Richmond, VA (US)

(73) Assignee: Honeywell International Inc., Moristown, NJ (US)

( * ) Notice: Subject to any disclaimer, the term of this patent is extended or adjusted under 35 U.S.C. 154(b) by 1585 days.

(21) Appl. No.: 11/527,905

(22) Filed: Sep. 26, 2006

(65) Prior Publication Data

US 2013/0112071 A1 May 9, 2013

(51) Int. Cl.
*F41H 1/02* (2006.01)
*F41H 1/00* (2006.01)

(52) U.S. Cl.
USPC ..... 2/2.5; 2/455; 89/36.05; 428/911

(58) Field of Classification Search
USPC ..... 2/2.5
See application file for complete search history.

(56) References Cited

U.S. PATENT DOCUMENTS 4,737,402 A 4/1988 Harpell et al.
5,165,989 A * 11/1992 Bhatnagar et al. ..... 442/134
5,480,706 A 1/1996 Li et al.
5,552,208 A * 9/1996 Lin et al. ..... 428/113
5,587,230 A * 12/1996 Lin et al. ..... 442/135
5,677,029 A 10/1997 Prevorsek et al. ..... 428/113
6,642,159 B1 * 11/2003 Bhatnagar et al. ..... 442/134
6,841,492 B2 * 1/2005 Bhatnagar et al. ..... 442/135
6,846,758 B2 * 1/2005 Bhatnagar et al. ..... 442/135
7,073,538 B2 * 7/2006 Bhatnagar et al. ..... 139/383 R
7,288,307 B2 * 10/2007 Bhatnagar et al. ..... 428/113
7,288,493 B2 * 10/2007 Bhatnagar et al. ..... 442/134
2003/0199215 A1 * 10/2003 Bhatnagar et al. ..... 442/135
2003/0228815 A1 * 12/2003 Bhatnagar et al. ..... 442/164
2004/0237763 A1 * 12/2004 Bhatnagar et al. ..... 89/36.02
2005/0153098 A1 * 7/2005 Bhatnagar et al. ..... 428/113
2007/0173150 A1 * 7/2007 Bhatnagar et al. ..... 442/135
2007/0194490 A1 * 8/2007 Bhatnagar et al. ..... 264/258
2007/0238379 A1 * 10/2007 Bhatnagar et al. ..... 442/135
2007/0293109 A1 * 12/2007 Bhatnagar et al. ..... 442/239

FOREIGN PATENT DOCUMENTS

WO 9100490 1/1991
WO WO 9100181 A1 * 1/1991 ..... B32B 27/04

* cited by examiner

*Primary Examiner* — Bobby Muromoto, Jr.

(57) ABSTRACT

Multilayer ballistic resistant articles formed from a combination of flexible and semi-rigid panel components. The flexible and semi-rigid panels may include woven fibrous layers, non-woven fibrous layers or both. The articles provide suitable protection against high energy ballistic threats, while remaining suitable for flexible vest applications.

24 Claims, No Drawings

FLEXIBLE BODY ARMOR WITH SEMI-RIGID AND FLEXIBLE COMPONENT

BACKGROUND OF THE INVENTION

1. Field of the Invention

This invention pertains to multi-panel ballistic resistant articles including both flexible and semi-rigid panel components. Each panel of the multi-panel ballistic resistant articles may include either woven or non-woven fibrous layers, or both. Semi-rigid panels are molded under varying pressures to achieve varying degrees of stiffness.

2. Description of the Related Art

Ballistic resistant articles containing high strength fibers that have excellent properties against projectiles are well known. Articles such as bullet resistant vests, helmets, vehicle panels and structural members of military equipment are typically made from fabrics comprising high strength fibers. High strength fibers conventionally used include polyethylene fibers, aramid fibers such as poly(phenylenediamine terephthalamide), graphite fibers, nylon fibers, glass fibers and the like. For many applications, such as vests or parts of vests, the fibers may be used in a woven or knitted fabric. For other applications, the fibers may be encapsulated or embedded in a matrix material to form non-woven rigid or flexible fabrics.

Various ballistic resistant constructions are known that are useful for the formation of hard or soft armor articles such as helmets, panels and vests. For example, U.S. Pat. Nos. 4,403,012, 4,457,985, 4,613,535, 4,623,574, 4,650,710, 4,737,402, 4,748,064, 5,552,208, 5,587,230, 6,642,159, 6,841,492, 6,846,758, all of which are incorporated herein by reference, describe ballistic resistant composites which include high strength fibers made from materials such as extended chain ultra-high molecular weight polyethylene. These composites display varying degrees of resistance to penetration by high speed impact from projectiles such as bullets, shells, shrapnel and the like.

For example, U.S. Pat. Nos. 4,623,574 and 4,748,064 disclose simple composite structures comprising high strength fibers embedded in an elastomeric matrix. U.S. Pat. No. 4,650,710 discloses a flexible article of manufacture comprising a plurality of flexible layers comprised of high strength, extended chain polyolefin (ECP) fibers. The fibers of the network are coated with a low modulus elastomeric material. U.S. Pat. Nos. 5,552,208 and 5,587,230 disclose an article and method for making an article comprising at least one network of high strength fibers and a matrix composition that includes a vinyl ester and diallyl phthalate. U.S. Pat. No. 6,642,159 discloses an impact resistant rigid composite having a plurality of fibrous layers which comprise a network of filaments disposed in a matrix, with elastomeric layers there between. The composite is bonded to a hard plate to increase protection against armor piercing projectiles.

Hybrid ballistic resistant structures, in and of themselves, are known. For example, U.S. Pat. Nos. 5,179,244 and 5,180,880 teach soft or hard body armor utilizing a plurality of plies made from dissimilar ballistic materials, joining aramid and non-aramid fiber plies into a combined structure and utilizing polymeric matrix materials that deteriorate when exposed to liquids. U.S. Pat. No. 5,926,842 also describes hybridized ballistic resistant structures utilizing polymeric matrix materials that deteriorate when exposed to liquids. Further, U.S. patent U.S. Pat. No. 6,119,575 teaches a hybrid structure containing a first section of aromatic fibers, a second section of a woven plastic and a third section of polyolefin fibers.

Currently, flexible body armor articles do not provide suitable protection against high energy ballistic threats, such as bullets and high energy fragments. Additionally, while hard armor articles do offer sufficient protection against high energy threats, they are not suitable for flexible vest applications. To solve this problem, the present invention provides a hybrid structure that incorporates the benefits of dissimilar materials and offers excellent ballistic protection at a light weight. Particularly, the invention provides hybrid ballistic resistant structures incorporating both flexible and semi-rigid components.

SUMMARY OF THE INVENTION

The invention provides a ballistic resistant article comprising:

a) at least one semi-rigid panel having a stiffness of at least about 250 ksi; said semi-rigid panel comprising a plurality of consolidated fibrous layers; each of the fibrous layers comprising a plurality of fibers, said fibers having a polymeric matrix composition thereon; and b) at least one flexible panel attached to said semi-rigid panel, the flexible panel comprising at least one fibrous layer; wherein the semi-rigid panel and the flexible panel comprise fibers having a tenacity of about 7 g/denier or more and a tensile modulus of about 150 g/denier or more.

The invention also provides a ballistic resistant article comprising:

a) at least one semi-rigid panel having a stiffness of at least about 250 ksi; said semi-rigid panel comprising a plurality of consolidated fibrous layers; each of the fibrous layers comprising a plurality of fibers, said fibers having a polymeric matrix composition thereon; said panel having outer surfaces, wherein at least one polymer film is attached to each of said outer surfaces; and b) at least one flexible panel attached to said semi-rigid panel, the flexible panel comprising at least one fibrous layer; wherein the semi-rigid panel and the flexible panel comprise fibers having a tenacity of about 7 g/denier or more and a tensile modulus of about 150 g/denier or more.

The invention further provides a method of producing a ballistic resistant article comprising:

a) forming a semi-rigid panel by arranging a plurality of fibrous layers into an array, and molding said array under a pressure sufficient to consolidate said fibrous layers, and thereby producing a semi-rigid panel having a stiffness of at least about 250 ksi; each of the fibrous layers comprising a plurality of fibers, said fibers having a tenacity of about 7 g/denier or more and a tensile modulus of about 150 g/denier or more, and said fibers having a polymeric matrix composition applied thereon; wherein said semi-rigid panel has outer surfaces;

b) optionally attaching at least one polymer film to one or both of said outer surfaces; and c) attaching a flexible panel to said semi-rigid panel, the flexible panel comprising at least one fibrous layer; said fibrous layer comprising fibers having a tenacity of about 7 g/denier or more and a tensile modulus of about 150 g/denier or more.

DETAILED DESCRIPTION OF THE INVENTION

The invention provides articles that have superior ballistic penetration resistance against high energy ballistic threats, including bullets and high energy fragments, such as shrapnel. The articles include two or more individual attached panels, each panel comprising high strength fibers having a tenacity of about 7 g/denier or more and a tensile modulus of about 150 g/denier or more, and wherein adjacent panels have different stiffnessess (rigidity) as measured by the ASTM D790 three-point testing method. Particularly, the ballistic resistant articles include at least one semi-rigid panel having a stiffness of at least about 250 ksi, and at least one flexible panel attached to said semi-rigid panel. For the purposes of the invention, a panel is "flexible" if it is capable of being bent repeatedly without injury or damage to the panel, and more particularly, a flexible panel described herein is flexible if it has a drapability length of at least about 20 mm as measured by Drape Test 1 described herein. The ballistic resistant articles of the invention may further include additional panels, preferably forming structures comprising alternating semi-rigid and flexible panels.

For the purposes of the present invention, a "fiber" is an elongate body the length dimension of which is much greater than the transverse dimensions of width and thickness. The cross-sections of fibers for use in this invention may vary widely. They may be circular, flat or oblong in cross-section. Accordingly, the term fiber includes filaments, ribbons, strips and the like having regular or irregular cross-section. They may also be of irregular or regular multi-lobal cross-section having one or more regular or irregular lobes projecting from the linear or longitudinal axis of the fibers. It is preferred that the fibers are single lobed and have a substantially circular cross-section.

As used herein, a "yarn" is a strand consisting of multiple filaments. An "array" describes an orderly arrangement of fibers or yarns, and a "parallel array" describes an orderly parallel arrangement of fibers or yarns. A fiber "layer" describes a planar arrangement of woven or non-woven fibers or yarns. A fiber "network" denotes a plurality of interconnected fiber or yarn layers. A "consolidated network" describes a consolidated (merged) combination of fiber layers with a matrix composition. As used herein, a "single layer" structure refers to monolithic structure composed of one or more individual fiber layers that have been consolidated into a single unitary structure. In general, a "fabric" may relate to either a woven or non-woven material.

The invention presents various embodiments that include two or more ballistic resistant panels. In a first preferred embodiment, a panel comprising one or more non-woven fibrous layers is positioned between two opposing panels that each comprise one or more woven fibrous layers. In a second preferred embodiment, a panel comprising one or more woven fibrous layers is positioned between two opposing panels that each comprise a plurality of non-woven fibrous layers. In other embodiments, each panel may be composed solely of non-woven fibrous layers, or solely of woven fibrous layers. Other embodiments may include other combinations of panels comprised of woven fibrous layers and panels comprised of non-woven fibrous layers. The panels are preferably joined together by means that are well known in the art, such as stitching. Further, the ballistic resistant articles of the invention typically include multiple flexible panels that are not molded together, yet only a single, monolithic, molded semi-rigid panel, as illustrated in the Examples.

Each embodiment of the invention includes at least one semi-rigid panel having a stiffness of at least about 250 ksi, and at least one flexible panel having a drapability of at least about 20 mm (according to Drape Test 1), wherein said semi-rigid and flexible panels preferably alternate in the multi-panel structure. Most broadly, the ballistic resistant material of the invention comprises one semi-rigid panel attached to one or more flexible panels. Each panel may comprise only woven fibrous layers, only non-woven fibrous layers, or a combination thereof.

In the preferred embodiments of the invention, a panel of non-woven fibrous layers comprises at least one single-layer, consolidated network of fibers in an elastomeric or rigid polymer composition, which polymer composition is also referred to in the art as a polymeric matrix composition. More particularly, a single-layer, consolidated network of fibers comprises a plurality of fibrous layers stacked together, each fibrous layer comprising a plurality of fibers coated with the polymeric matrix composition and unidirectionally aligned in an array so that they are substantially parallel to each other along a common fiber direction. As is conventionally known in the art, excellent ballistic resistance is achieved when individual fiber layer are cross-plied such that the fiber alignment direction of one layer is rotated at an angle with respect to the fiber alignment direction of another layer. Accordingly, successive layers of such unidirectionally aligned fibers are preferably rotated with respect to a previous layer. An example is a two layer (two ply) structure wherein adjacent layers (plies) are aligned in a 0°/90° orientation, where each individual non-woven ply is also known as a "unitape". However, adjacent layers can be aligned at virtually any angle between about 0° and about 90° with respect to the longitudinal fiber direction of another layer. For example, a five layer non-woven structure may have plies at a 0°/45°/90°/45°/0° orientation or at other angles. In the preferred embodiment of the invention, only two individual non-woven plies, cross-plied at 0° and 90°, are consolidated into a single layer network, wherein one or more of said single layer networks make up a single non-woven panel. However, it should be understood that the single-layer consolidated networks of the invention may generally include any number of cross-plied (or non-cross-plied) plies. Most typically, the single-layer consolidated networks include from 1 to about 6 plies, but may include as many as about 10 to about 20 plies as may be desired for various applications. Such rotated unidirectional alignments are described, for example, in U.S. Pat. Nos. 4,457,985; 4,748,064; 4,916,000; 4,403,012; 4,623,573; and 4,737,402. Likewise, a "panel" is a monolithic structure that may include any number of component fiber layers or plies, and typically includes 1 to about 65 fiber layers or plies, and each panel may comprise a plurality of fibrous layers which comprise non-woven fibers, a plurality of fibrous layers which comprise woven fibers, or a combination of woven fibrous layers and non-woven fibrous layers. A ballistic resistant material of the invention may also comprise at least one panel which comprises a plurality of fibrous layers which comprise non-woven fibers and at least one panel which comprises a plurality of fibrous layers which comprise woven fibers.

The stacked fibrous layers are consolidated, or united into a monolithic structure by the application of heat and pressure, to form the single-layer, consolidated network, merging the fibers and the matrix composition of each component fibrous layer. The non-woven fiber networks can be constructed using well known methods, such as by the methods described in U.S. Pat. No. 6,642,159. The consolidated network may also comprise a plurality of yarns that are coated with such a matrix composition, formed into a plurality of layers and consolidated into a fabric. The non-woven fiber networks may also comprise a felted structure which is formed using conventionally known techniques, comprising fibers in a random orientation embedded in a suitable matrix composition that are matted and compressed together.

For the purposes of the present invention, the term "coated" is not intended to limit the method by which the polymeric matrix composition is applied onto the fiber surface or surfaces. The application of the matrix is conducted prior to consolidating the fiber layers, and any appropriate method of applying the polymeric matrix composition onto the fiber surfaces may be utilized. Accordingly, the fibers of the invention may be coated on, impregnated with, embedded in, or otherwise applied with a matrix composition by applying the matrix composition to the fibers and then optionally consolidating the matrix composition-fibers combination to form a composite. As stated above, by "consolidating" it is meant that the matrix material and each individual fiber layer are combined into a single unitary layer. Consolidation can occur via drying, cooling, heating, pressure or a combination thereof The term "composite" refers to consolidated combinations of fibers with the matrix material. As discussed previously, the term "matrix" as used herein is well known in the art, and is used to represent a binder material, such as a polymeric binder material, that binds the fibers together after consolidation.

The woven fibrous layers of the invention are also formed using techniques that are well known in the art using any fabric weave, such as plain weave, crowfoot weave, basket weave, satin weave, twill weave and the like. Plain weave is most common. Prior to weaving, the individual fibers of each woven fibrous material may or may not be coated with a polymeric matrix composition in a similar fashion as the non-woven fibrous layers using the same matrix compositions as the non-woven fibrous layers.

Each panel of woven or non-woven fibrous layers preferably comprises a plurality of fibrous layers, where the greater the number of layers translates into greater ballistic resistance, but also greater weight. A non-woven fibrous panel, in particular, preferably comprises two or more layers that are consolidated into a monolithic panel. A woven fibrous panel may also comprise a plurality of consolidated woven fibrous layers. Additionally, in a preferred embodiment of the invention, a plurality of flexible panels may be attached to a plurality of semi-rigid panels, and at least one additional flexible panel may be further attached to the other side of the group of semi-rigid panels, or at least one additional semi-rigid panel may be further attached to the other side of the group of flexible panels, or both. For example, ten individual flexible panels of a woven fibrous material are attached to one surface of a semi-rigid panel which comprises ten non-woven fibrous layers consolidated into a single layer network, and another ten individual panels of a woven fibrous material are attached to an opposing surface of the semi-rigid panel. In this embodiment, each of the individual flexible panels may include as few as one woven fabric layer or a plurality of adjoined fabric layers.

Each of the flexible panels may be adjoined in a bonded array prior to being attached to the semi-rigid panel. Alternately, each of the flexible panels may be initially stacked or adjoined in a non-bonded array, followed by subsequently interconnecting all of the flexible panels and the semi-rigid panel (or semi-rigid panels) together to form a bonded array. In general, the multiple panels of the invention may be adjoined in a bonded array or may be juxtaposed in a non-bonded array. Most preferably, the multi-panel structures of the invention are interconnected such that they are reciprocally connected to function as a single unit. Methods of bonding are well known in the art, and include stitching, quilting, bolting, adhering with adhesive materials, and the like. Preferably, said plurality of layers are attached by stitching together at edge areas of the layers, such as by tack stitching.

The number of layers forming a single panel, and the number of layers forming the non-woven composite vary depending upon the ultimate use of the desired ballistic resistant article. For example, in body armor vests for military applications, in order to form an article composite that achieves a desired 1.0 pound per square foot areal density (4.9 $kg/m^2$), a total of at 22 individual layers (or plies) may be required, wherein the plies may be woven, knitted, felted or non-woven fabrics formed from the high-strength fibers described herein, and the layers may or may not be attached together. In another embodiment, body armor vests for law enforcement use may have a number of layers based on the National Institute of Justice (NIJ) Threat Level. For example, for an NIJ Threat Level IIIA vest, there may also be a total of 22 layers. For a lower NIJ Threat Level, fewer layers may be employed.

In another preferred embodiment of the invention, at least one polymer film is attached to each of the outer surfaces of the semi-rigid panel. A polymer film may be desired to decrease friction between panels, because some panel types have sticky or rubbery surfaces. Suitable polymers for said polymer film non-exclusively include thermoplastic and thermosetting polymers. Suitable thermoplastic polymers non-exclusively may be selected from the group consisting of polyolefins, polyamides, polyesters, polyurethanes, vinyl polymers, fluoropolymers and co-polymers and mixtures thereof. Of these, polyolefin layers are preferred. The preferred polyolefin is a polyethylene. Non-limiting examples of polyethylene films are low density polyethylene (LDPE), linear low density polyethylene (LLDPE), linear medium density polyethylene (LMDPE), linear very-low density polyethylene (VLDPE), linear ultra-low density polyethylene (ULDPE), high density polyethylene (HDPE). Of these, the most preferred polyethylene is LLDPE. Suitable thermosetting polymers non-exclusively include thermoset allyls, aminos, cyanates, epoxies, phenolics, unsaturated polyesters, bismaleimides, rigid polyurethanes, silicones, vinyl esters and their copolymers and blends, such as those described in U.S. Pat. Nos. 6,846,758, 6,841,492 and 6,642,159. As described herein, a polymer film includes polymer coatings. In a preferred embodiment, the ballistic resistant articles of the invention include a semi-rigid panel which comprises a plurality of unidirectional, non-woven fiber layers that are cross-plied at a non-parallel angle relative to a longitudinal fiber direction of each adjacent fiber layer, said panel having outer surfaces and wherein at least one polymer film is attached to each of said outer surfaces.

The polymer films are preferably attached to one or both of the outer surfaces of a semi-rigid panel using well known lamination techniques. The polymer films may also be attached to one or both of the outer surfaces of a flexible panel, but preferably the flexible panels are not laminated with a polymer film. Typically, laminating is done by positioning the individual layers on one another under conditions of sufficient heat and pressure to cause the layers to combine into a unitary film. The individual layers are positioned on one another, and the combination is then typically passed through the nip of a pair of heated laminating rollers by techniques well known in the art. Lamination heating may be done at temperatures ranging from about 95° C. to about 175° C., preferably from about 105° C. to about 175° C., at pressures ranging from about 5 psig (0.034 MPa) to about 100 psig (0.69 MPa), for from about 5 seconds to about 36 hours, preferably from about 30 seconds to about 24 hours. Alternately, polymeric film or films may be attached to said semi-rigid panel during the molding step described below. In the preferred embodiment of the invention, the polymer film layers preferably comprise from about 2% to about 25% by weight of the overall fabric, more preferably from about 2% to about 17% percent by weight of the overall fabric and most preferably from 2% to 12%. The percent by weight of the polymer film layers will generally vary depending on the number of fabric layers forming a panel.

In forming the semi-rigid panels and optionally the flexible panels, multiple fibrous layers are molded under heat and pressure in a suitable molding apparatus. Generally, the panels are molded at a pressure of from about 50 psi (344.7 kPa) to about 5000 psi (34474 kPa), more preferably about 100 psi (689.5 kPa) to about 1500 psi (10342 kPa), most preferably from about 150 psi (1034 kPa) to about 1000 psi (6895 kPa). The fibrous layers may alternately be molded at higher pressures of from about 500 psi (3447 kPa) to about 5000 psi, more preferably from about 750 psi (5171 kPa) to about 5000 psi and more preferably from about 1000 psi to about 5000 psi. The molding step may take from about 4 seconds to about 45 minutes. Preferred molding temperatures range from about 200° F. (~93° C.) to about 350° F. (~177° C.), more preferably at a temperature from about 200° F. to about 300° F. (~149° C.) and most preferably at a temperature from about 200° F. to about 280° F. (~138° C.). Suitable molding temperatures, pressures and times will generally vary depending on the type of polymer matrix type, polymer matrix content, and type of fiber. While the flexible panels may be molded under low pressures, they preferably are neither coated with a polymeric matrix composition nor molded. Further, while each of molding and consolidation techniques described herein may appear similar, each process is different. Particularly, molding is a batch process and consolidation is a continuous process. Further, molding typically involves the use of a mold, such as a shaped mold or a match-die mold when forming a flat panel.

If a separate consolidation step is conducted to form one or more single layer, consolidated networks prior to molding, the consolidation may be conducted in an autoclave, as is conventionally known in the art. When heating, it is possible that the matrix can be caused to stick or flow without completely melting. However, generally, if the matrix material is caused to melt, relatively little pressure is required to form the composite, while if the matrix material is only heated to a sticking point, more pressure is typically required. The consolidation step may generally take from about 10 seconds to about 24 hours. Similar to molding, suitable consolidation temperatures, pressures and times are generally dependent on the type of polymer, polymer content, process used and type of fiber.

The pressure under which the fabrics of the invention are molded has a direct effect on the stiffness of the resulting molded product. Particularly, the higher the pressure at which the fabrics are molded, the higher the stiffness, and vice-versa. Most preferably, the semi-rigid fabrics of the invention are molded at high pressures, and the flexible panels of the invention are molded at low pressures, or the flexible panels are not molded at all. In addition to the molding pressure, the, quantity, thickness and composition of the fabric layers, matrix type and optional polymer film also directly affects the stiffness of the articles formed from the inventive fabrics.

Preferably, the molded, semi-rigid panels of the invention have a stiffness of at least about 250 ksi to about 2000 ksi, more preferably from about 270 ksi to about 1500 ksi and most preferably about 300 ksi to about 1000 ksi, as measured by the three point test method of ASTM D790. The flexible panels are most preferably are not molded and may or may not include a polymeric matrix composition coating or polymeric film layers on their outer surfaces. Preferably, flexible panels that are not molded, uncoated with a polymeric composition, and also which are also not laminated with a polymer film on either of the opposing panel surfaces, have stiffness of from about 0.1 ksi to about 50 ksi, more preferably from about 1 ksi to about 30 ksi and more preferably about 2 ksi to about 20 ksi, as measured by the three point test method of ASTM D790, together with a drapability of about 20 mm to about 200 mm as determined by Drape Test 1 described herein. Flexible panels that include both a coating of a polymeric matrix composition, and which are also laminated with at least one outer polymeric film, have a stiffness of less than 250 ksi, preferably from about 50 ksi to about 249 ksi, more preferably about 50 ksi to about 200 ksi, and most preferably from about 50 ksi to about 150 ksi.

In the preferred embodiment of the invention, the flexible panels have a drapability of from about 20 mm to about 200 mm, as measured by the Drape Test 1 testing method described in U.S. Pat. No. 5,677,029 (see Example 3), the disclosure of which is incorporated herein by reference. More preferably the flexible panels have a drapability of from about 30 mm to about 200 mm and most preferably from about 50 mm to about 200 mm, as measured by the Drape Test 1 testing method. As described in Drape Test 1,300 mm×300 mm square samples are tested by hanging the sample over the straight edge of a horizontal flat plane and measuring the bending of the fabric under its own mass. Distances (i.e. bending lengths) are measured from the center of the overhang to the apex of the overhang. Particularly, assuming that the horizontal flat plane lies in horizontal plane X, and the bottom edge of the sample overhang lies in horizontal plane Y below plane X, the drapability is the distance between planes X and Y. In the present invention, 300 mm×300 mm square samples are prepared and tested, with multiple panels being tack stitched on all four sides, 10 mm inside the edge, 25 mm from each corner, each side having two 50 mm long tack stitches. The samples are hung over 200 mm from a horizontal metal edge and drapability is measured by measuring the deflection of the lower end of the sample from the edge. The higher the deflection, the higher the flexibility. For a molded semi-rigid panel, deflection is low, and as the number of layers in a semi-rigid molded panel increases, the drapability approaches and may reach zero mm. According to this method, a sample having a drapability of 200 mm is the most flexible, where a sample having a drapability of 200 mm (i.e. the full length of the fabric overhang) according to the above tests will drape over the edge of the flat plane at approximately 90°. It should be understood that the maximum drapability would be greater than 200 mm if the length of the sample overhang was greater than 200 mm. However, following the particular method above where only 200 mm of a sample is hung over the edge of a flat plane, the maximum overhang length is 200 mm.

The ballistic resistant articles of the invention comprising a combination of at least one semi-rigid panel and at least one flexible panel have a preferred drapability of from about 30 mm to about 120 mm, more preferably from about 35 mm to about 150 mm and most preferably from about 40 mm to about 180 mm, as measured by the above described Drape Test 1 testing method. Another measure of drapability is described by the ASTM D1388, Option A Cantilever Test, which has been used to measure the stiffness of a single-ply fabric. The ASTM D1388-96, Option A cantilever testing method employs the principle of cantilever bending of fabric under its own weight. The testing apparatus is a horizontal platform having a smooth low-friction flat surface with a leveling bubble. The indicator is an inclined platform at an angle of 41.5±0.5° below the plane of the horizontal platform.

The test measures the length of fabric that must be extended off the platform for the fabric to bend sufficiently to reach the indicator platform at 41.5±0.5°. The more flexible a fabric is, the shorter the bending length will be to reach the indicator platform. According to ASTM D1388-96, the recommended sample size is 25 mm×200 mm. However, this method is adopted for use with single fabric layers, and due to the bulk of the multi layer panels of the invention, and in some cases, the semi-rigid nature of the panel, the test was modified to use a sample size of 25 mm×460 mm. According to this modified ASTM D1388 Cantilever Test method, the flexible panels of the invention have a bending length of from 20 mm to 65 mm, more preferably from 20 mm to 60 mm and most preferably from 20 mm to 55 mm, as measured by the modified ASTM D 1388-96 method. According to the modified ASTM D1388 Cantilever Test method, the combination of at least one semi-rigid panel and at least one flexible panel have a preferred bending length of from about 69 mm to 200 mm, more preferably from 80 mm to 180 mm and most preferably from 100 mm to 160 mm.

The panels or fabrics of the invention may optionally be calendared under heat and pressure to smooth or polish their surfaces. Calendaring methods are well known in the art and may be conducted prior to or after molding. Preferably, the flexible panels are neither molded nor calendared.

In the event that a polymer film is attached to one or both of the outer surfaces of either a semi-rigid panel and/or a flexible panel, it is most preferred that the multiple fibrous layers comprising panels are joined together in a single molding step with said polymer film. The molding step may optionally serve the additional function of consolidating all of the individual layers of the invention. For example, the molding step may serve to consolidate a plurality of cross-plied, non-woven fiber layers forming a consolidated network as described above. However, the molding process must be conducted under conditions suitable to achieve flexible and semi-rigid panels having the stiffness and drapability properties specified herein.

The woven or non-woven fibrous layers of the invention may be prepared using a variety of matrix materials, including both low modulus, elastomeric matrix materials and high modulus, rigid matrix materials. Suitable matrix materials non-exclusively include low modulus, elastomeric materials having an initial tensile modulus less than about 6,000 psi (41.3 MPa), and high modulus, rigid materials having an initial tensile modulus at least about 300,000 psi (2068 MPa), each as measured at 37° C. by ASTM D638. As used herein throughout, the term tensile modulus means the modulus of elasticity as measured by ASTM 2256 for a fiber and by ASTM D638 for a matrix material.

An elastomeric matrix composition may comprise a variety of polymeric and non-polymeric materials. The preferred elastomeric matrix composition comprises a low modulus elastomeric material. For the purposes of this invention, a low modulus elastomeric material has a tensile modulus, measured at about 6,000 psi (41.4 MPa) or less according to ASTM D638 testing procedures. Preferably, the tensile modulus of the elastomer is about 4,000 psi (27.6 MPa) or less, more preferably about 2400 psi (16.5 MPa) or less, more preferably 1200 psi (8.27

MPa) or less, and most preferably is about 500 psi (3.45 MPa) or less. The glass transition temperature (Tg) of the elastomer is preferably less than about 0° C., more preferably the less than about −40° C., and most preferably less than about −50° C. The elastomer also has an preferred elongation to break of at least about 50%, more preferably at least about 100% and most preferably has an elongation to break of at least about 300%.

A wide variety of matrix materials and formulations having a low modulus may be utilized as the matrix. Representative examples include polybutadiene, polyisoprene, natural rubber, ethylene-propylene copolymers, ethylene-propylene-diene terpolymers, polysulfide polymers, polyurethane elastomers, chlorosulfonated polyethylene, polychloroprene, plasticized polyvinylchloride, butadiene acrylonitrile elastomers, poly(isobutylene-co-isoprene), polyacrylates, polyesters, polyethers, fluoroelastomers, silicone elastomers, copolymers of ethylene, and combinations thereof, and other low modulus polymers and copolymers curable below the melting point of the polyolefin fiber. Also preferred are blends of different elastomeric materials, or blends of elastomeric materials with one or more thermoplastics.

Particularly useful are block copolymers of conjugated dienes and vinyl aromatic monomers. Butadiene and isoprene are preferred conjugated diene elastomers. Styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type A-B-A, multi-block copolymers of the type $(AB)_n$ (n=2-10) or radial configuration copolymers of the type $R-(BA)_x$ (x=3-150); wherein A is a block from a polyvinyl aromatic monomer and B is a block from a conjugated diene elastomer. Many of these polymers are produced commercially by Kraton Polymers of Houston, Tex. and described in the bulletin "Kraton Thermoplastic Rubber", SC-68-81. The most preferred matrix polymer comprises styrenic block copolymers sold under the trademark Kraton® commercially produced by Kraton Polymers. The most preferred low modulus matrix composition comprises a polystyrene-polyisoprene-polystrene-block copolymer.

Preferred high modulus, rigid matrix materials useful herein include materials such as a vinyl ester polymer or a styrene-butadiene block copolymer, and also mixtures of polymers such as vinyl ester and diallyl phthalate or phenol formaldehyde and polyvinyl butyral. A particularly preferred rigid matrix material for use in this invention is a thermosetting polymer, preferably soluble in carbon-carbon saturated solvents such as methyl ethyl ketone, and possessing a high tensile modulus when cured of at least about $1\times10^6$ psi (6895 MPa) as measured by ASTM D638. Particularly preferred rigid matrix materials are those described in U.S. Pat. No. 6,642,159, which is incorporated herein by reference.

In addition to the non-woven fibrous layers, the woven fibrous layers are also preferably coated with the polymeric matrix composition. Preferably the fibers comprising the woven fibrous layers are at least partially coated with a polymeric matrix composition, followed by a consolidation step similar to that conducted with non-woven fibrous layers. However, coating the woven fibrous layers with a polymeric matrix composition is not required. For example, a plurality of woven fibrous layers forming a flexible panel of the invention do not necessarily have to be consolidated, and may be attached by other means, such as with a conventional adhesive, or by stitching. Generally, a polymeric matrix composition coating is necessary to efficiently merge, i.e. consolidate, a plurality of fibrous layers. In an embodiment of the invention, the fibers comprising the at least one fibrous layer of said flexible panel may be at least partially coated with a polymeric matrix composition, whether the fibrous layer or layers are woven or non-woven.

The rigidity, impact and ballistic properties of the articles formed from the fabric composites of the invention are effected by the tensile modulus of the matrix polymer. For example, U.S. Pat. No. 4,623,574 discloses that fiber reinforced composites constructed with elastomeric matrices having tensile moduli less than about 6000 psi (41,300 kPa) have superior ballistic properties compared both to composites constructed with higher modulus polymers, and also compared to the same fiber structure without a matrix. However, low tensile modulus matrix polymers also yield lower rigidity composites. Further, in certain applications, particularly those where a composite must function in both anti-ballistic and structural modes, there is needed a superior combination of ballistic resistance and rigidity. Accordingly, the most appropriate type of matrix polymer to be used will vary depending on the type of article to be formed from the fabrics of the invention. In order to achieve a compromise in both properties, a suitable matrix composition may combine both low modulus and high modulus materials to form a single matrix composition.

In the preferred embodiment of the invention, the proportion of the matrix composition making up each non-woven composite panel (semi-rigid or flexible) preferably comprises from about 5% to about 30% by weight of the composite, more preferably from about 7% to about 20% by weight of the composite, more preferably from about 7% to about 16% and most preferably from about 11% to about 15% by weight of the composite. The proportion of an optional matrix composition making up each woven composite panel (semi-rigid or flexible) preferably comprises from about 0% to about 50% by weight of the composite, more preferably from about 3% to about 35% by weight of the composite and most preferably from about 5% to about 25% by weight of the composite. The matrix composition may also include fillers such as carbon black or silica, may be extended with oils, or may be vulcanized by sulfur, peroxide, metal oxide or radiation cure systems as is well known in the art.

The remaining portion of the composite is preferably composed of fibers. In accordance with the invention, the fibers comprising each of the woven and non-woven fibrous layers preferably comprise high-strength, high tensile modulus fibers. As used herein, a "high-strength, high tensile modulus fiber" is one which has a preferred tenacity of at least about 7 g/denier or more, a preferred tensile modulus of at least about 150 g/denier or more, and preferably an energy-to-break of at least about 8 J/g or more, each both as measured by ASTM D2256. As used herein, the term "denier" refers to the unit of linear density, equal to the mass in grams per 9000 meters of fiber or yarn. As used herein, the term "tenacity" refers to the tensile stress expressed as force (grams) per unit linear density (denier) of an unstressed specimen. The "initial modulus" of a fiber is the property of a material representative of its resistance to deformation. The term "tensile modulus" refers to the ratio of the change in tenacity, expressed in grams-force per denier (g/d) to the change in strain, expressed as a fraction of the original fiber length (in/in).

Particularly suitable high-strength, high tensile modulus fiber materials include polyolefin fibers, particularly extended chain polyolefin fibers, such as highly oriented, high molecular weight polyethylene fibers, particularly ultra-high molecular weight polyethylene fibers and ultra-high molecular weight polypropylene fibers. Also suitable are aramid fibers, particularly para-aramid fibers, polyamide fibers, polyethylene terephthalate fibers, polyethylene naphthalate fibers, extended chain polyvinyl alcohol fibers, extended chain polyacrylonitrile fibers, polybenzazole fibers, such as polybenzoxazole (PBO) and polybenzothiazole (PBT) fibers, and liquid crystal copolyester fibers. Each of these fiber types is conventionally known in the art.

In the case of polyethylene, preferred fibers are extended chain polyethylenes having molecular weights of at least 500,000, preferably at least one million and more preferably between two million and five million. Such extended chain polyethylene (ECPE) fibers may be grown in solution spinning processes such as described in U.S. Pat. Nos. 4,137,394 or 4,356,138, which are incorporated herein by reference, or may be spun from a solution to form a gel structure, such as described in U.S. Pat. Nos. 4,551,296 and 5,006,390, which are also incorporated herein by reference. A particularly preferred fiber type for use in the invention are polyethylene fibers sold under the trademark SPECTRA® from Honeywell International Inc. SPECTRA® fibers are well known in the art and are described, for example, in U.S. Pat. Nos. 4,623,547 and 4,748,064.

Also particularly preferred are aramid (aromatic polyamide) or para-aramid fibers. Such are commercially available and are described, for example, in U.S. Pat. No. 3,671,542. For example, useful poly(p-phenylene terephthalamide) filaments are produced commercially by Dupont corporation under the trade name of KEVLAR®. Also useful in the practice of this invention are poly(m-phenylene isophthalamide) fibers produced commercially by Dupont under the trade name NOMEX® and fibers produced commercially by Teijin under the trade name TWARON®.

Suitable polybenzazole fibers for the practice of this invention are commercially available and are disclosed for example in U.S. Pat. Nos. 5,286,833, 5,296,185, 5,356,584, 5,534,205 and 6,040,050, each of which are incorporated herein by reference. Preferred polybenzazole fibers are ZYLON® brand fibers from Toyobo Co. Suitable liquid crystal copolyester fibers for the practice of this invention are commercially available and are disclosed, for example, in U.S. Pat. Nos. 3,975,487; 4,118,372 and 4,161,470, each of which is incorporated herein by reference.

Suitable polypropylene fibers include highly oriented extended chain polypropylene (ECPP) fibers as described in U.S. Pat. No. 4,413,110, which is incorporated herein by reference. Suitable polyvinyl alcohol (PV-OH) fibers are described, for example, in U.S. Pat. Nos. 4,440,711 and 4,599,267 which are incorporated herein by reference. Suitable polyacrylonitrile (PAN) fibers are disclosed, for example, in U.S. Pat. No. 4,535,027, which is incorporated herein by reference. Each of these fiber types is conventionally known and widely commercially available.

The other suitable fiber types for use in the present invention include glass fibers, fibers formed from carbon, fibers formed from basalt or other minerals, rigid rod fibers such as M5® fibers, and combinations of all the above materials, all of which are commercially available. For example, the fibrous layers may be formed from a combination of SPECTRA® fibers and Kevlar® fibers. M5® fibers are manufactured by Magellan Systems International of Richmond, Va. and are described, for example, in U.S. Pat. Nos. 5,674,969, 5,939,553, 5,945,537, and 6,040,478, each of which is incorporated herein by reference. Specifically preferred fibers include M5® fibers, polyethylene SPECTRA® fibers, and aramid Kevlar® fibers. The fibers may be of any suitable denier, such as, for example, 50 to about 3000 denier, more preferably from about 200 to 3000 denier, still more preferably from about 650 to about 2000 denier, and most preferably from about 800 to about 1500 denier.

The most preferred fibers for the purposes of the invention are either high-strength, high tensile modulus extended chain polyethylene fibers or high-strength, high tensile modulus para-aramid fibers. As stated above, a high-strength, high tensile modulus fiber is one which has a preferred tenacity of about 7 g/denier or more, a preferred tensile modulus of about 150 g/denier or more and a preferred energy-to-break of about 8 J/g or more, each as measured by ASTM D2256. In the preferred embodiment of the invention, the tenacity of the fibers should be about 15 g/denier or more, preferably about 20 g/denier or more, more preferably about 25 g/denier or more and most preferably about 30 g/denier or more. The fibers of the invention also have a preferred tensile modulus of about 300 g/denier or more, more preferably about 400 g/denier or more, more preferably about 500 g/denier or more, more preferably about 1,000 g/denier or more and most preferably about 1,500 g/denier or more. The fibers of the invention also have a preferred energy-to-break of about 15 J/g or more, more preferably about 25 J/g or more, more preferably about 30 J/g or more and most preferably have an energy-to-break of about 40 J/g or more.

These combined high strength properties are obtainable by employing well known processes. U.S. Pat. Nos. 4,413,110, 4,440,711, 4,535,027, 4,457,985, 4,623,547 4,650,710 and 4,748,064 generally discuss the formation of preferred high strength, extended chain polyethylene fibers employed in the present invention. Such methods, including solution grown or gel fiber processes, are well known in the art. Methods of forming each of the other preferred fiber types, including para-aramid fibers, are also conventionally known in the art, and the fibers are commercially available.

As discussed above, the matrix may be applied to a fiber in a variety of ways, and the term "coated" is not intended to limit the method by which the matrix composition is applied onto the fiber surface or surfaces. For example, the polymeric matrix composition may be applied in solution form by spraying or roll coating a solution of the matrix composition onto fiber surfaces, wherein a portion of the solution comprises the desired polymer or polymers and a portion of the solution comprises a solvent capable of dissolving the polymer or polymers, followed by drying. Another method is to apply a neat polymer of the coating material to fibers either as a liquid, a sticky solid or particles in suspension or as a fluidized bed. Alternatively, the coating may be applied as a solution or emulsion in a suitable solvent which does not adversely affect the properties of the fiber at the temperature of application. For example, the fiber can be transported through a solution of the matrix composition to substantially coat the fiber and then dried to form a coated fiber. The resulting coated fiber can then be arranged into the desired network configuration. In another coating technique, a layer of fibers may first be arranged, followed by dipping the layer into a bath of a solution containing the matrix composition dissolved in a suitable solvent, such that each individual fiber is substantially coated with the matrix composition, and then dried through evaporation of the solvent. The dipping procedure may be repeated several times as required to place a desired amount of matrix composition coating on the fibers, preferably encapsulating each of the individual fibers or covering 100% of the fiber surface area with the matrix composition.

While any liquid capable of dissolving or dispersing a polymer may be used, preferred groups of solvents include water, paraffin oils and aromatic solvents or hydrocarbon solvents, with illustrative specific solvents including paraffin oil, xylene, toluene, octane, cyclohexane, methyl ethyl ketone (MEK) and acetone. The techniques used to dissolve or disperse the coating polymers in the solvents will be those conventionally used for the coating of similar materials on a variety of substrates.

Other techniques for applying the coating to the fibers may be used, including coating of the high modulus precursor (gel fiber) before the fibers are subjected to a high temperature stretching operation, either before or after removal of the solvent from the fiber (if using the gel-spinning fiber forming technique). The fiber may then be stretched at elevated temperatures to produce the coated fibers. The gel fiber may be passed through a solution of the appropriate coating polymer under conditions to attain the desired coating. Crystallization of the high molecular weight polymer in the gel fiber may or may not have taken place before the fiber passes into the solution. Alternatively, the fiber may be extruded into a fluidized bed of an appropriate polymeric powder. Furthermore, if a stretching operation or other manipulative process, e.g. solvent exchanging, drying or the like is conducted, the coating may be applied to a precursor material of the final fiber. In the most preferred embodiment of the invention, the fibers of the invention are first coated with the matrix composition, followed by arranging a plurality of fibers into either a woven or non-woven fiber layer. Such techniques are well known in the art.

The thickness of the individual fabric layers and panels will correspond to the thickness of the individual fibers. Accordingly, a preferred woven fibrous layer will have a preferred thickness of from about 25 μm to about 500 μm, more preferably from about 75 μm to about 385 μm and most preferably from about 125 μm to about 255 μm. A preferred single-layer, consolidated network will have a preferred thickness of from about 12 μm to about 500 μm, more preferably from about 75 μm to about 385 μm and most preferably from about 125 μm to about 255 μm. A polymer film is preferably very thin, having preferred thicknesses of from about 1 μm to about 250 μm, more preferably from about 5 μm to about 25 μm and most preferably from about 5 μm to about 9 μm. The combined article, including the semi-rigid panel or panels, the flexible panel or panels, and any optional polymer films, has a preferred total thickness of about 5 μm to about 1000 μm, more preferably from about 6 μm to about 750 μm and most preferably from about 7 μm to about 500 μm. While such thicknesses are preferred, it is to be understood that other film thicknesses may be produced to satisfy a particular need and yet fall within the scope of the present invention. The multi-panel articles of the invention further have a preferred areal density of from about 0.25 lb/ft$^2$ (psf) (1.22 kg/m$^2$ (ksm)) to about 2.0 psf (9.76 ksm), more preferably from about 0.5 psf (2.44 ksm) to about 1.5 psf (7.32 ksm), more preferably from about 0.7 psf (3.41 ksm) to about 1.5 psf (7.32 ksm), and most preferably from about 0.75 psf (3.66 ksm) to about 1.25 psf (6.1 ksm).

The multi-panel structures of the invention may be used in various applications to form a variety of different ballistic resistant articles using well known techniques. For example, suitable techniques for forming ballistic resistant articles are described in, for example, U.S. Pat. Nos. 4,623,574, 4,650,710, 4,748,064, 5,552,208, 5,587,230, 6,642,159, 6,841,492 and 6,846,758.

The multi-panel structures are particularly useful for the formation of flexible, soft armor articles, including garments such as vests, pants, hats, or other articles of clothing, and covers or blankets, used by military personnel to defeat a number of ballistic threats, such as 9 mm full metal jacket (FMJ) bullets and a variety of fragments generated due to explosion of hand-grenades, artillery shells, Improvised Explosive Devices (IED) and other such devises encountered in military and peace keeping missions. As used herein, "soft" or "flexible" armor is armor that does not retain its shape when subjected to a significant amount of stress and is incapable of being free-standing without collapsing. The multi-panel structures are also useful for the formation of rigid, hard armor articles. By "hard" armor is meant an article, such as helmets, panels for military vehicles, or protective shields, which have sufficient mechanical strength so that it maintains structural rigidity when subjected to a significant amount of stress and is capable of being freestanding without collapsing. The structures can be cut into a plurality of discrete sheets and stacked for formation into an article or they can be formed into a precursor which is subsequently used to form an article. Such techniques are well known in the art.

Garments of the invention may be formed through methods conventionally known in the art. Preferably, a garment may be formed by adjoining the ballistic resistant articles of the invention with an article of clothing. For example, a vest may comprise a generic fabric vest that is adjoined with the ballistic resistant structures of the invention, whereby the inventive articles are inserted into strategically placed pockets. This allows for the maximization of ballistic protection, while minimizing the weight of the vest. As used herein, the terms "adjoining" or "adjoined" are intended to include attaching, such as by sewing or adhering and the like, as well as unattached coupling or in juxtaposition with another fabric, such that the ballistic resistant articles may optionally be easily removable from the vest or other article of clothing. Articles used in forming flexible structures like flexible sheets, vests and other garments are preferably formed from using a low tensile modulus matrix composition. Hard articles like helmets and armor are preferably formed using a high tensile modulus matrix composition. In practical use, multiple panels are commonly held together within an enclosure, such as a pocket of a vest, inside a car panel, within the outer fabric of a protective blanket, etc.

The ballistic resistance properties are determined using standard testing procedures that are well known in the art. Particularly, the protective power or penetration resistance of a structure is normally expressed by citing the impacting velocity at which 50% of the projectiles penetrate the composite while 50% are stopped by the ballistic target, also known as the $V_{50}$ value. As used herein, the "penetration resistance" of an article is the resistance to penetration by a designated threat, such as physical objects including bullets, fragments, shrapnel and the like, and non-physical objects, such as a blast from explosion. For composites of equal areal density, which is the weight of the composite panel divided by the surface area, the higher the $V_{50}$, the better the resistance of the composite. The ballistic resistant properties of the articles of the invention will vary depending on many factors, particularly the type of fibers used to manufacture the fabrics.

Flexible ballistic armor with areal density of 1.09 psf formed herein preferably have a $V_{50}$ of at least about 1920 feet/second (fps) (585.6 m/sec) when impacted with a 16 grain right circular cylinder (RCC) projectile as tested by military testing standard MIL-STD-662E. Flexible ballistic armor formed herein preferably have a $V_{50}$ of at least about 1400 feet/second (fps) (427 m/sec) when impacted with a 17 grain fragment simulated projectile (fsp) as tested by military testing standard MIL-STD-662E. The fragment shape, size and weight of a 17 grain fsp are described by military projectile specification MIL-P-46593A.

The following non-limiting examples serve to illustrate the invention.

EXAMPLE 1 (COMPARATIVE)

A ballistic shoot pack consisting only of a single flexible panel having 33 layers of flexible SPECTRA Shield® LCR material having a polymer film on each opposing surface), was assembled and tested according to military testing standard MIL-STD-662E. Each of the 33 layers consisted of two consolidated, non-woven plies (two unitapes) cross-plied at 0°/90° (i.e. 33 monolithic structures). The size of the shoot pack was 18"×18" (46 cm×46 cm). The total areal density of the 33 layer shoot pack was 1.01 psf (4.92 ksm). All four corners of the shoot packs were stitched at a 45 degree angle about 2 inches (50 cm) from the corners. The stitching holds the layers in place during ballistic testing.

The shoot pack was firmly clamped between two rigid steel frames, and was backed by air. The entire fixture with shoot pack was mounted on a vertical rigid metal frame. After clamping and mounting of the shoot pack, the open area available for testing is approximately 15"×15". Several approximately equally spaced 17 grain Fragment Simulating Projectiles (FSP) were fired at the shoot pack with at least a three inch (76 mm) spacing between each fragment hitting the shoot pack. The striking velocity was varied depending upon if the previous fragment penetrated the shoot pack or was stopped by the shoot pack. The $V_{50}$ was calculated based on at least 5 partial penetrations and 5 complete penetrations, spread within 125 ft/second (38 m/second). A summary of the ballistic testing and $V_{50}$ test results is shown in Table 1.

EXAMPLE 2

Similar to Example 1, another shoot pack was assembled and tested against 17 grain FSP for $V_{50}$ according to military testing standard MIL-STD-662E. However, this shoot pack configuration consisted of a semi-rigid panel having 5 molded layers of SPECTRA Shield® PCR (consolidated into a monolithic structure) and a flexible panel having 28 layers of flexible SPECTRA Shield® LCR (each of the 28 layers consisting of two consolidated, non-woven plies (two unitapes) cross-plied at 0°/90°). The shoot pack included a total of 33 fibrous layers and had a total areal density of 1.01 psf (4.92 ksm). The panels were stitched together adjoining the 28 layers of SPECTRA Shield® LCR and the monolithic SPECTRA Shield® PCR panel. A summary of the ballistic testing and $V_{50}$ test results is shown in Table 1.

EXAMPLE 3

A similar shoot pack as from Example 2 was assembled and tested against 17 grain FSP for $V_{50}$ according to military testing standard MIL-STD-662E . However, the shoot pack was turned around and the projectile was fired at the flexible panel comprising 28 layers of flexible SPECTRA Shield® LCR. The shoot pack included a total of 33 fibrous layers and had a total areal density of 1.01 psf (4.92 ksm). The panels were stitched together as described in Example 2. A summary of the ballistic testing and $V_{50}$ test results is shown in Table 1.

EXAMPLE 4

Similar to Example 1, another shoot pack was assembled and tested against 17 grain FSP for $V_{50}$ according to military testing standard MIL-STD-662E.

However, this shoot pack layer configuration consisted of a flexible panel having 14 layers of flexible SPECTRA Shield® LCR (each of the 14 layers consisting of two consolidated, non-woven plies cross-plied at (0°/90°), followed by a semi-rigid panel including 5 molded layers of SPECTRA Shield® PCR (consolidated into a monolithic structure) and followed by another flexible panel having 14 layers of flexible SPECTRA Shield® LCR. The shoot pack included a total of 33 fibrous layers and had a total areal density of 1.01 psf (4.92 ksm). The panels were stitched together as described in Example 2. A summary of the ballistic testing and $V_{50}$ test results is shown in Table 1.

TABLE 1

Shoot pack size: 18" × 18"
Test Standard: MIL-STD-662E
Ballistic threat: 17 grain Fragment Simulating Projectile

| Example | Composition | Layers | Average $V_{50}$, 17 grain FSP (ft/second) (m/second) | Drapability** (mm) |
|---|---|---|---|---|
| 1 | I | 33 | 1650 (503 m/sec) | 68 |
| 2 | II | 33 | 1704 (519 m/sec) | 48 |
| 3 | III | 33 | 1769 (539 m/sec) | 48 |
| 4 | IV | 33 | 1783 (544 m/sec) | 52 |

I = 33 total layers of flexible SPECTRA Shield ® LCR;
II = 5 molded* layers of SPECTRA Shield ® PCR + 28 layers of flexible SPECTRA Shield ® LCR;
III = 28 layers of flexible SPECTRA Shield ® LCR + 5 molded* layers of SPECTRA Shield ® PCR;
IV = 14 layers of flexible SPECTRA Shield ® LCR + 5 molded* layers of SPECTRA Shield ® PCR + 14 layers of flexible SPECTRA Shield ® LCR.
*Molding conditions: molded at 500 psi pressure at 240° F. (115.6° C.) for 10 minutes and then cooled down to 140° F. (60° C.). Molded layers are merged into a monolithic structure.
**DRAPABILITY TEST: The following drapability test was conducted on shoot packs shown in Examples 1-4, according to the method of Drape Test 1 described above. The size of sample for drapability test was 300 mm × 300 mm. The samples were tack stitched on all four sides, 10 mm inside the edge, 25 mm from each corner. Each side had two 50 mm long tack stitches. The samples were hung over 200 mm from a horizontal 90° metal edge and drapability was measured by measuring the deflection of the lower end of the sample from the edge. The higher the deflection, the higher the flexibility. For a molded rigid panel the deflection should be zero mm.

The ballistic testing shows that the performance of ballistic materials is increased by a) adding semi-flexible layers in the shoot pack; and b) the location of semi-rigid layer in the flexible vest determine the increased protection level. The results show that Example 1 has the highest flexibility (drapability).

EXAMPLE 5

A ballistic shoot pack consisting of 13 flexible panels, each flexible panel a layer of aramid fabric style 751, followed by a semi-rigid panel having 12 molded* layers of Gold Shield® material GN 2115 (forming a semi-rigid panel) and followed by another 13 flexible panels, each comprising a layer of aramid fabric style 751, was assembled and tested according to military testing standard MIL-STD-662E. The size of the shoot pack was 18"×18" (46 cm×46 cm). The total areal density of the 38 layer shoot pack was 1.09 psf (5.32 ksm). All four corners of the shoot pack were stitched at a 45 degree angle about 2 inches (50 cm) from the corners, forming a bonded array.

The shoot pack was firmly clamped between two rigid steel frames, and was backed by air. The entire fixture with shoot pack was mounted on a vertical rigid metal frame. Several approximately equally spaced 17 grain Fragment Simulating Projectiles (FSP) were fired at the shoot pack with at least a three inch (76 mm) spacing between each fragment hitting the shoot pack. The striking velocity was varied depending upon if the previous fragment penetrated the shoot pack or was stopped by the shoot pack. The $V_{50}$ was calculated based on at least 5 partial penetrations and 5 complete penetrations, spread within 125 ft/second (38 m/second). A summary of the ballistic testing and $V_{50}$ test results is shown in Table 2.

EXAMPLE 6

An 18"×18" shoot pack was assembled consisting of a flexible panel having 13 layers of aramid fabric style 751 followed by 6 semi-rigid molded panels, each semi-rigid panel consisting of two layers of Gold Shield® material GN 2115, and followed by another flexible panel having 13 layers of aramid fabric style 751. The shoot pack included a total of 33 fibrous layers and had a total areal density of 1.09 psf (5.32 ksm). The layers were stitched together as described in Example 5. The shoot pack was tested according to military testing standard MIL-STD-662E, and a summary of the ballistic testing and $V_{50}$ test results is shown in Table 2.

EXAMPLE 7

An 18"×18" shoot pack was assembled consisting of a flexible panel having 13 layers of aramid fabric style 751 followed by 4 semi-rigid molded panels, each semi-rigid panel consisting of three layers of Gold Shield® material GN 2115, and followed by another flexible panel having 13 layers of aramid fabric style 751. The shoot pack included a total of 33 fibrous layers and had a total areal density of 1.09 psf (5.32 ksm). The panels were stitched together as described in Example 5. The shoot pack was tested according to military testing standard MIL-STD-662E, and a summary of the ballistic testing and $V_{50}$ test results is shown in Table 2.

EXAMPLE 8

An 18"×18" shoot pack was assembled consisting of a flexible panel having 13 layers of aramid fabric style 751 followed by 3 semi-rigid molded panels, each semi-rigid panel consisting of four layers of Gold Shield® material GN 2115, and followed by another flexible panel having 13 layers of aramid fabric style 751. The shoot pack included a total of 33 fibrous layers and had a total areal density of 1.09 psf (5.32 ksm). The panels were stitched together as described in Example 5. The shoot pack was tested according to military testing standard MIL-STD-662E, and a summary of the ballistic testing and $V_{50}$ test results is shown in Table 2.

TABLE 2

Shoot pack size: 18" × 18"
Test Standard: MIL-STD-662E
Ballistic threat: 17 grain Fragment Simulating Projectile

| Example | Composition | Layers | Average $V_{50}$, 17 grain FSP (ft/second) (m/second) | Drapability** (mm) |
|---|---|---|---|---|
| 5 | A | 38 | 1974 (602 m/s) | 135 |
| 6 | B | 38 | 2081 (634 m/s) | 104 |
| 7 | C | 38 | 2058 (627 m/s) | 82 |
| 8 | D | 38 | 2030 (619 m/s) | 55 |

A = 13 layers of aramid fabric style 751 + 12 individually molded* single layers of Gold Shield ® material GN 2115 + 13 layers of aramid fabric style 751;
B = 13 layers of aramid fabric style 751 + 6 sets of two molded* layers of Gold Shield ® material GN 2115 + 13 layers of aramid fabric style 751;
C = 13 layers of aramid fabric style 751 + 4 sets of three molded* layers of Gold Shield ® material GN 2115 + 13 layers of aramid fabric style 751;
D = 13 layers of aramid fabric style 751 + 3 sets of four molded* layers of Gold Shield ® material GN 115 + 13 layers of aramid fabric style 751.
*Molding conditions were the same as for Examples 1-4.
**Drapability test was the same as for Examples 1-4.

EXAMPLE 9

The bending lengths of the aramid fiber based semi-rigid flexible shoot packs having constructions A, B, C and D, as described in Examples 5-8, were measured according to the ASTM D1388-96, Option A cantilever testing method. The cantilever test employs the principle of cantilever bending of fabric under its own weight. The testing apparatus is a horizontal platform having a smooth low-friction flat surface with a leveling bubble. The indicator is an inclined platform at an angle of 41.5±0.5° below the plane of the horizontal platform. The sample used to measure bending length was 25 mm wide and 460 mm long. According to ASTM D1388-96, the recommended sample size is 25 mm×200 mm. However due to bulk of 38 layers and semi-rigid nature of the shoot pack, the sample size adopted was 25 mm×460 mm. The component layers were tack stitched only one side of the sample. The stitched side was used for overhanging from the horizontal platform.

In accordance with the testing method, the sample was placed on the horizontal platform parallel to the platform edge and covered with 0.5 cm thick, 2.54 cm wide and 46 cm long molded plastic sheet. The covered sample was moved by hand in a smooth manner at about 120 mm/min until the edge of the sample touched the inclined platform at 41.5±0.5°. The overhang length was measured using a linear scale to the nearest 1 mm. The bending length was calculated using the equation C=O/2, where C=bending length (cm) and O=length of overhang (cm).

The shoot pack was also tested for ballistic resistance according to military testing standard MIL-STD-662E, and a summary of the ballistic testing and $V_{50}$ test results is shown in Table 3.

TABLE 3

Shoot pack size: 15" × 15"
Test Standard: MIL-STD-662E
Ballistic threat: 17 grain Fragment Simulating Projectile

| Composition | Layers | Areal Density (psf) | Average $V_{50}$, 17 grain FSP (ft/second) (m/second) | Flexural rigidity (mg-cm) | Bending length (cm) |
|---|---|---|---|---|---|
| A | 38 | 1.09 | 1974 (602 m/sec) | 135115 | 6.91 |
| B | 38 | 1.09 | 2081 (634 m/sec) | 522114 | 10.32 |
| C | 38 | 1.09 | 2058 (627 m/sec) | 960937 | 12.55 |
| D | 38 | 1.09 | 2030 (619 m/sec) | 14999923 | 13.92 |

The above examples collectively illustrate a) that the performance of ballistic materials is increased by combining both semi-rigid and flexible panels in a shoot pack; b) rigidity and layer count in each semi-rigid panel effects the ballistic performance; and c) flexibility of the shoot pack is reduced as more layers are molded into a semi-rigid panel.

EXAMPLE 10

The bending lengths of the SPECTRA® fiber based semi-rigid flexible shoot packs having constructions I, II, III and IV, as described in Examples 1-4, were measured according to the ASTM D1388-96, Option A cantilever testing method. Similar to Example 9, the sample used to measure bending length was 25 mm wide and 460 mm long, and the component layers were tack stitched only one side of the sample. The stitched side was used for overhanging from the horizontal platform.

The shoot pack was also tested for ballistic resistance according to military testing standard MIL-STD-662E, and a summary of the ballistic testing and $V_{50}$ test results is shown in Table 4.

TABLE 4

Shoot pack size: 18" × 18"
Test Standard: MIL-STD-662E
Ballistic threat: 17 grain Fragment Simulating Projectile

| Composition | Layers | Areal Density (psf) | Average $V_{50}$, 17 grain FSP (ft/second) (m/second) | Bending length (cm) |
|---|---|---|---|---|
| I | 33 | 1.01 | 1650 (503 m/sec) | 10.32 |
| II | 33 | 1.01 | 1704 (519 m/sec) | 16.51 |
| III | 33 | 1.01 | 1769 (539 m/sec) | 15.24 |
| IV | 33 | 1.01 | 1783 (544 m/sec) | 15.87 |

EXAMPLE 11

A bending length test for 100% Aramid fabric style 751 shoot packs was conducted according to the ASTM D1388-96, Option A cantilever testing method. The sample size was 1" wide (2.54 cm)×46 cm long and consisted of 33 layers of Style 751, weighing 1.01 psf (4.93 ksm). Also tested was a sample having 36 layers of Style 751, weighing 1.09 psf (5.32 ksm). The results are summarized in Table 5 below.

TABLE 5

| Layers | Areal Density psf (ksm) | Bending length (cm) |
|---|---|---|
| 33 | 1.01 (4.93) | 5.5 |
| 36 | 1.09 (5.32) | 6.4 |

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A ballistic resistant article comprising:

a) at least one semi-rigid panel having a stiffness of at least about 250 ksi; said semi-rigid panel comprising a plurality of consolidated fibrous layers; each of the fibrous layers comprising a plurality of fibers, said fibers having a polymeric matrix composition thereon; and b) at least one flexible panel attached to said semi-rigid panel, the flexible panel comprising at least one fibrous layer; wherein the semi-rigid panel and the flexible panel comprise fibers having a tenacity of about 7 g/denier or more and a tensile modulus of about 150 g/denier or more.

2. The ballistic resistant article of claim 1 wherein the semi-rigid panel comprises a plurality of consolidated non-woven fibrous layers.

3. The ballistic resistant article of claim 1 wherein the flexible panel comprises at least one woven fibrous layer.

4. The ballistic resistant article of claim 1 further comprising:

c) at least one additional flexible panel attached to said semi-rigid panel, said flexible panel having a drapability of at least about 20 mm according to Drape Test 1; or c) at least one additional semi-rigid panel attached to said flexible panel, said additional semi-rigid panel having a stiffness of at least about 250 ksi.

5. The ballistic resistant article of claim 1 wherein a combination of said at least one semi-rigid panel and said at least one flexible panel has a drapability of from about 30 mm to about 120 mm as measured by Drape Test 1, or wherein a combination of said at least one semi-rigid panel and said at least one flexible panel has a bending length of from about 69 mm to 200 mm as measured by the ASTM D1388-96, Option A cantilever testing method modified to use a sample size of 25 mm×460 mm.

6. The ballistic resistant article of claim 1 wherein each panel independently comprises one or more polyolefin fibers, aramid fibers, polybenzazole fibers, polyvinyl alcohol fibers, polyamide fibers, polyethylene terephthalate fibers, polyethylene naphthalate fibers, polyacrylonitrile fibers, liquid crystal copolyester fibers, glass fibers, carbon fibers, rigid rod fibers, or a combination thereof.

7. The ballistic resistant article of claim 1 wherein said semi-rigid panel comprises a plurality of unidirectional, non-woven fiber layers that are cross-plied at a non-parallel angle relative to a longitudinal fiber direction of each adjacent fiber layer.

8. A flexible body armor product which comprises the ballistic resistant article of claim 1.

9. The ballistic resistant article of claim 1 wherein the flexible panel has a drapability of at least about 20 mm according to Drape Test 1 and a stiffness of from 0.1 ksi to about 50 ksi as measured by ASTM D790.

10. A ballistic resistant article comprising:

a) at least one semi-rigid panel having a stiffness of at least about 250 ksi; said semi-rigid panel comprising a plurality of consolidated fibrous layers; each of the fibrous layers comprising a plurality of fibers, said fibers having a polymeric matrix composition thereon; said panel having outer surfaces, wherein at least one polymer film is attached to each of said outer surfaces; and b) at least one flexible panel attached to said semi-rigid panel, the flexible panel comprising at least one fibrous layer; wherein the semi-rigid panel and the flexible panel comprise fibers having a tenacity of about 7 g/denier or more and a tensile modulus of about 150 g/denier or more.

11. The ballistic resistant article of claim 10 wherein the semi-rigid panel comprises a plurality of consolidated non-woven fibrous layers.

12. The ballistic resistant article of claim 10 wherein the flexible panel comprises at least one woven fibrous layer.

13. The ballistic resistant article of claim 10 further comprising:

c) at least one additional flexible panel attached to said semi-rigid panel, said flexible panel having a drapability of at least about 20 mm according to Drape Test 1; or c) at least one additional semi-rigid panel attached to said flexible panel, said additional semi-rigid panel having a stiffness of at least about 250 ksi; said additional panel having outer surfaces, wherein at least one polymer film is attached to each of said outer surfaces.

14. The ballistic resistant article of claim 10 wherein a combination of said at least one semi-rigid panel and said at least one flexible panel has a drapability of from about 30 mm to about 120 mm as measured by Drape Test 1, or wherein a combination of said at least one semi-rigid panel and said at least one flexible panel has a bending length of from about 69 mm to 200 mm as measured by the ASTM D1388-96, Option A cantilever testing method modified to use a sample size of 25 mm×460 mm.

15. A flexible body armor product which comprises the ballistic resistant article of claim 10.

16. The ballistic resistant article of claim 10 wherein said polymer film layers comprise a material selected from the group consisting of selected from the group consisting of polyolefins, polyamicles, polyesters, polyurethanes, vinyl polymers, fluoropolymers and copolymers and combinations thereof.

17. The ballistic resistant article of claim 10 wherein said polymer film layers comprise a linear low density polyethylene.

18. The ballistic resistant article of claim 10 wherein the flexible panel has a drapability of at least about 20 mm according to Drape Test 1 and a stiffness of from 0.1 ksi to about 50 ksi as measured by ASTM D790.

19. A method of producing a ballistic resistant article comprising:

a) forming a semi-rigid panel by aiTanging a plurality of fibrous layers into an array, and molding said array under a pressure sufficient to consolidate said fibrous layers, and thereby producing a semi-rigid panel having a stiffness of at least about 250 ksi; each of the fibrous layers comprising a plurality of fibers, said fibers having a tenacity of about 7 g/denier or more and a tensile modulus of about 150 g/denier or more, and said fibers having a polymeric matrix composition applied thereon; wherein said semi-rigid panel has outer surfaces;

b) optionally attaching at least one polymer film to one or both of said outer surfaces; and c) attaching a flexible panel to said semi-rigid panel, the flexible panel comprising at least one fibrous layer; said fibrous layer comprising fibers having a tenacity of about 7 g/denier or more and a tensile modulus of about 150 g/denier or more, and d) wherein a combination of said at least one semi-rigid panel and said at least one flexible panel has a drapability of from about 30 mm to about 120 mm as measured by Drape Test 1, or wherein a combination of said at least one semi-rigid panel and said at least one flexible panel has a bending length of from about 69 mm to 200 mm as measured by the ASTM D1388-96, Option A cantilever testing method modified to use a sample size of 25 mm×460 mm.

20. The method of claim 19 wherein said semi-rigid panel is formed by molding a plurality of non-woven fibrous layers which layers comprise a plurality of unidirectional fibers, and wherein each non-woven layer is cross-plied at a non-parallel angle relative to the longitudinal fiber direction of each adjacent non-woven layer.

21. The ballistic resistant article of claim 1 wherein said at least one flexible panel comprises a non-molded, non-heat bonded array of fabrics.

22. The ballistic resistant article of claim 10 wherein said at least one flexible panel comprises a non-molded, non-heat bonded array of fabrics.

23. The ballistic resistant article of claim 1 wherein said semi-rigid panel comprises a plurality of consolidated non-woven fibrous layers and the flexible panel comprises at least one woven fibrous layer.

24. The ballistic resistant article of claim 10 wherein said semi-rigid panel comprises a plurality of consolidated non-woven fibrous layers and the flexible panel comprises at least one woven fibrous layer.

* * * * *